US008631647B2

(12) United States Patent
Neels et al.

(10) Patent No.: US 8,631,647 B2
(45) Date of Patent: Jan. 21, 2014

(54) SYSTEM AND METHOD FOR REGENERATING AN ENGINE EXHAUST AFTER-TREATMENT DEVICE

(75) Inventors: Jacobus Neels, Rosedale (CA); Richard Sederquist, Middletown, CT (US); Xuantian Li, Richmond (CA); Lasitha Cumaranatunge, Burnaby (CA); Campbell R. McConnell, Vancouver (CA)

(73) Assignee: Westport Power Inc., Vancouver, British Columbia (CA)

( * ) Notice: Subject to any disclaimer, the term of this patent is extended or adjusted under 35 U.S.C. 154(b) by 382 days.

(21) Appl. No.: 13/011,372

(22) Filed: Jan. 21, 2011

(65) Prior Publication Data

US 2011/0173953 A1 Jul. 21, 2011

Related U.S. Application Data

(60) Provisional application No. 61/297,267, filed on Jan. 21, 2010, provisional application No. 61/391,505, filed on Oct. 8, 2010.

(51) Int. Cl.
*F01N 3/20* (2006.01)

(52) U.S. Cl.
USPC ..... 60/295; 60/274; 60/286; 60/297; 60/301; 60/303

(58) Field of Classification Search
USPC ..... 60/274, 286, 295, 297, 301, 303; 48/197 R, 198.7
See application file for complete search history.

(56) References Cited

U.S. PATENT DOCUMENTS

| | | | | |
|---|---|---|---|---|
| 5,388,406 | A * | 2/1995 | Takeshima et al. | 60/297 |
| 5,921,076 | A * | 7/1999 | Krutzsch et al. | 60/274 |
| 6,820,417 | B2 * | 11/2004 | May et al. | 60/297 |
| 7,076,944 | B2 | 7/2006 | Okugawa et al. | |
| 7,093,428 | B2 * | 8/2006 | LaBarge et al. | 60/286 |
| 7,240,483 | B2 | 7/2007 | Cizeron et al. | |
| 7,591,132 | B2 * | 9/2009 | Viola | 60/286 |
| 7,703,278 | B2 * | 4/2010 | Kobayashi et al. | 60/297 |
| 7,707,826 | B2 * | 5/2010 | Wang et al. | 60/295 |
| 7,861,521 | B2 * | 1/2011 | Zhang et al. | 60/286 |
| 8,037,674 | B2 * | 10/2011 | Kupe et al. | 60/286 |
| 8,336,302 | B2 * | 12/2012 | Nakahira | 60/303 |
| 2003/0163988 | A1 * | 9/2003 | Kirwan et al. | 60/289 |
| 2003/0200742 | A1 | 10/2003 | Smaling | |
| 2006/0179821 | A1 | 8/2006 | Zhan et al. | |
| 2007/0180819 | A1 * | 8/2007 | Sellnau et al. | 60/286 |

(Continued)

OTHER PUBLICATIONS

R. Zhan, Y. Huang, and M. Khair, "Methodologies to Control DPF Uncontrolled Regenerations," SAE Technical Paper No. 2006-01-1090 (2006).

*Primary Examiner* — Thomas Denion
*Assistant Examiner* — Jorge Lean, Jr.
(74) *Attorney, Agent, or Firm* — Corridor Law Group, LLC

(57) ABSTRACT

A system and method for regenerating a device in an engine exhaust after-treatment system is provided. To regenerate the device, a syngas stream is introduced into the engine exhaust stream and combusts in the presence of a catalyst in the after-treatment system, raising the temperature. A supplemental liquid fuel stream is then selectively introduced into and is vaporized by the syngas stream to form a combined fuel stream. Combustion of the combined fuel stream with the engine exhaust in the presence of the catalyst further heats the device bringing it to a temperature suitable for regeneration. The catalyst can be upstream of or within the device being regenerated.

29 Claims, 9 Drawing Sheets

(56) References Cited

U.S. PATENT DOCUMENTS

| | | | | |
|---|---|---|---|---|
| 2007/0266701 | A1 | 11/2007 | Cheng | |
| 2008/0000219 | A1* | 1/2008 | Ratcliff et al. | 60/274 |
| 2008/0000221 | A1 | 1/2008 | Silvis | |
| 2008/0022660 | A1* | 1/2008 | Reuter et al. | 60/286 |
| 2008/0053073 | A1* | 3/2008 | Kalyanaraman et al. | 60/286 |
| 2008/0314032 | A1 | 12/2008 | Li et al. | |
| 2010/0005788 | A1 | 1/2010 | McConnell et al. | |
| 2010/0077733 | A1* | 4/2010 | Winkler et al. | 60/286 |

* cited by examiner

SYSTEM AND METHOD FOR REGENERATING AN ENGINE EXHAUST AFTER-TREATMENT DEVICE

CROSS-REFERENCE TO RELATED APPLICATIONS

This application is related to and claims priority benefits from U.S. Provisional Patent Application Ser. No. 61/297,267, filed on Jan. 21, 2010, entitled "System And Method For Regenerating An Engine Exhaust After-Treatment Device" and from U.S. Provisional Patent Application Ser. No. 61/391,505, filed on Oct. 8, 2010, entitled "System And Method For Regenerating An Engine Exhaust After-Treatment Device", each of which is hereby incorporated by reference in its entirety.

FIELD OF INVENTION

The present invention relates to a system and method for regenerating an after-treatment device in an engine exhaust after-treatment system. In particular, the present invention relates to a method to actively heat and regenerate an engine exhaust after-treatment device using a syngas stream, as well as a vaporized liquid fuel and engine exhaust.

BACKGROUND OF THE INVENTION

Exhaust after-treatment systems are employed for reducing regulated emissions from an exhaust stream of an engine system. An exhaust after-treatment system can comprise one or more of the same or different types of after-treatment devices including, for example, diesel oxidation catalysts (DOCS), diesel particulate filters (DPFs), and lean NOx traps (LNTs), lean NOx catalyst, or other catalysts and/or adsorbents.

Diesel particulate filters, also known as particulate filters, particulate traps, soot filters or soot traps, can be employed to reduce the levels of particulates in an engine exhaust stream prior to its release into the atmosphere. The filter can optionally contain a catalyst material. Particulates in the engine exhaust stream are trapped and collected by the filter. Eventually the accumulation of particulates adversely obstructs the flow of the engine exhaust stream through the filter, causing the pressure drop across the filter to be undesirably high. Various in situ regeneration techniques have been employed to regenerate DPFs by burning off (oxidizing) and removing the particulate matter, thereby restoring the pressure drop across the filter to desirable levels. DPF regeneration can be done passively or by using specific active regeneration techniques. Almost all active filter regeneration techniques operate by raising the temperature of particulates collected in the filter to a temperature at which the particulates will oxidize rapidly in the presence of oxygen present in the engine exhaust stream.

In some cases the filter temperature can be increased to a value suitable for regeneration by using electrical or microwave heating or by using a hot flue gas stream produced by a burner. Other prior approaches to actively regenerate a DPF in situ involve adjusting the operation of the engine to increase the temperature of the engine exhaust stream. Examples of such techniques include throttling of the engine, and/or post-injection of fuel into the engine exhaust stream, for example, periodically introducing diesel or a hydrogen-containing gas stream upstream of the DPF. As the mixed gas stream travels through the DPF, the DPF is heated by combustion of the mixture which can be promoted by an optional catalyst located upstream of and/or within the DPF. The regeneration process is an exothermic process which can be initiated above a threshold temperature (for example, above about 550° C. for a DPF without catalyst and above about 400° C. for a DPF with catalyst), and requires the presence of oxygen in the engine exhaust stream. The regeneration process can be self-sustaining provided there are sufficient amounts of heat, oxygen and particulates. DPFs can also employ a segmented regeneration strategy in which a segment or portion of the DPF is regenerated while other segments are not being regenerated. Regenerating only a portion of the DPF at a given time can reduce the mass flow rate of fuel needed for regeneration, enabling a reduction of the size and cost of some system components.

Lean NOx traps (LNTs) can be employed to reduce the level of nitrogen oxides (NOx) in an engine exhaust stream prior to its release into the atmosphere. LNTs operate by employing adsorbents to adsorb NOx from the engine exhaust stream during lean (excess oxygen) conditions, and using a regeneration process in which NOx is desorbed from the absorbents and then converted during reducing or rich (excess fuel) and elevated temperature conditions. The regeneration process can restore the capacity of a LNT to adsorb NOx and typically is performed prior to reaching the adsorption capacity of the LNT. Creating a reducing environment, by removing most of the oxygen as well as introducing a reducing agent into the LNT, reduces the temperature at which regeneration will occur. Combusting a reducing agent can consume most of the oxygen and increase the temperature sufficiently for regeneration. Suitable reducing agents include, for example, syngas, hydrogen, diesel, carbon monoxide, or other hydrocarbon fuels.

Sulfur (S) species, originating from the engine fuel and oil, can be present in the engine exhaust stream. As the engine exhaust flows through a LNT, sulfur tends to be preferentially adsorbed over NOx, occupying the available adsorbent sites and "poisoning" the catalyst. A desulfation process can be part of a LNT regeneration process, and can be employed to remove the sulfur species and restore the NOx adsorption capacity of the LNT. The desulfation process typically occurs at a higher temperature than the NOx desorption process. For example, NOx desorption typically starts at a temperature of about 200° C. while desulfation typically starts at a temperature of at least about 500° C. Prior approaches to desulfating a LNT involve increasing the temperature of the engine exhaust stream to a sufficient temperature (by adjusting the operation of the engine) as well as typically introducing a fuel into the engine exhaust stream to provide further heating through catalytic combustion of the mixture promoted by a catalyst, preferably located upstream of the LNT.

Once the temperature is sufficiently high for LNT regeneration (for example, NOx desorption and/or desulfation) to occur, the engine exhaust stream is typically diverted away from the LNT in order to reduce the amount of oxygen present in the LNT, and create a reducing condition that facilitates regeneration.

In some of the regeneration processes described above, a liquid fuel, for example, diesel is introduced, and vaporized in the engine exhaust stream, then ignited over a DOC (or other catalyst within the after-treatment system) to provide heat for regeneration. However, during certain operating conditions of an engine, the temperature of the engine exhaust stream can be too low to adequately vaporize liquid diesel. For example, the vaporization of diesel generally requires a temperature greater than 250° C., yet the engine exhaust can be at a lower temperature. If the liquid diesel is not adequately vaporized or if vaporized diesel and exhaust mixture is not kept hot enough (resulting in condensation of diesel), the liquid fuel can potentially damage downstream after-treatment devices and/or systems, for example, causing hot spots, hydrocarbon carryover, or producing additional residues, carbon or particulates.

Instead of using diesel, a syngas stream comprising hydrogen ($H_2$) and carbon monoxide (CO) can be employed as a fuel in the various regeneration processes described above. Employing syngas as a fuel for heating and/or to create a reducing condition during regeneration offers advantages. For example, because syngas ignites at a lower temperature than vaporized diesel, the threshold temperature required to initiate the regeneration processes can potentially be lowered. Also, typically regeneration can be performed using syngas without the need to alter the operating condition of the engine. Furthermore, with respect to LNT regeneration, higher NOx conversion efficiencies and desulfation efficiencies are typically achieved at lower temperatures in LNTs employing syngas relative to using diesel. If syngas is to be used, generally a fuel processor or syngas generator (SGG) is employed in the after-treatment system, and is sized to provide sufficient syngas output and/or heating duty for regeneration of one or more after-treatment devices in the system.

The present approach employs a syngas stream and then a combined fuel stream in a multi-stage process for regeneration of an engine exhaust after-treatment device. The combined fuel stream comprises a product stream from a syngas generator along with a supplemental fuel, such as diesel. Employing a combined fuel stream takes advantage of properties of both the product stream and the supplemental fuel, and can overcome at least some of the shortcomings of prior techniques.

SUMMARY OF THE INVENTION

A method of regenerating an exhaust after-treatment device in an exhaust after-treatment system comprises:

(a) directing an engine exhaust stream from an engine through the exhaust after-treatment device;

(b) introducing a syngas stream into the engine exhaust stream and combusting at least a portion of the syngas in the presence of a catalyst to heat the exhaust after-treatment device;

(c) subsequently introducing a supplemental liquid fuel stream into the syngas stream to vaporize the supplemental liquid fuel stream, forming a mixed gas stream comprising syngas, vaporized liquid fuel and engine exhaust; and (d) combusting at least a portion of the mixed gas stream in the presence of the catalyst to further heat the exhaust after-treatment device.

Some embodiments of the method further comprise monitoring a temperature in the exhaust after-treatment system, and initiating step (c) when the temperature reaches a first threshold value. For example, the temperature can be monitored in the vicinity of the catalyst, and the first threshold temperature can be at least the ignition temperature of the mixed gas stream.

In some embodiments of the method, in step (d) the combustion heats the exhaust after-treatment device so that it reaches at least a second temperature threshold value that is suitable for regeneration of the exhaust after-treatment device.

Generally the syngas is introduced into the engine exhaust stream upstream of the after-treatment device, and the supplemental liquid fuel is also introduced into the syngas stream upstream of the after-treatment device.

In some embodiments of the method, the after-treatment device to be regenerated is a particulate filter, such as a diesel particulate filter (DPF). In this case, preferably the second temperature threshold is sufficiently high that oxidation of particulates accumulated in the filter occurs. The method can optionally further comprise monitoring a pressure drop in the exhaust after-treatment system, and initiating step (b) when the pressure drop increases above a first threshold value, and/or stopping the introduction of the syngas and the liquid fuel when the pressure drop drops below a second threshold value, whereby regeneration of the DPF is terminated. The first and second pressure drop threshold values can be the same or different from one another.

In other embodiments of a method of regenerating an exhaust after-treatment device in an exhaust after-treatment system, the after-treatment device is a lean NOx trap. In this case, the method can optionally further comprise monitoring for NOx slip past the lean NOx trap, and initiating step (b) when the NOx slip increases above a first NOx slip threshold value. In some embodiments of the method, in step (d) the combustion heats the lean NOx trap so that it reaches at least a second temperature threshold value that is suitable for regeneration of the lean NOx trap.

In some embodiments of the method of regenerating a lean NOx trap, the method further comprises:

(e) monitoring a temperature in the exhaust after-treatment system; and (f) once the second temperature threshold value is reached, diverting the engine exhaust stream so that it bypasses the lean NOx trap and stopping the introduction of the supplemental liquid fuel stream into the syngas stream.

In another aspect, a method of regenerating an exhaust after-treatment device in an exhaust after-treatment system comprises:

(a) directing an engine exhaust stream from a combustion engine through the exhaust after-treatment device;

(b) monitoring at least one operating parameter of the exhaust after-treatment system;

(c) selectively introducing a syngas stream into the engine exhaust stream based on the value of at least a first one of the monitored parameters;

(d) combusting at least a portion of the syngas in the presence of a catalyst to heat the exhaust after-treatment device;

(e) selectively introducing a supplemental liquid fuel stream into the syngas stream based on the value of at least a second one of the monitored parameters, to vaporize the supplemental liquid fuel stream, forming a combined fuel stream comprising syngas, vaporized supplemental liquid fuel; and (f) combusting at least a portion of the combined fuel stream in the presence of the catalyst to further heat the exhaust after-treatment device.

The first and second parameter can be the same or different and can be, for example, elapsed time, temperature at a location in the exhaust after-treatment system, pressure at a location in the exhaust after-treatment system, pressure drop across at least a portion of the exhaust after-treatment system, or engine exhaust stream mass flow rate.

In yet another aspect, a method of regenerating an exhaust after-treatment device in an exhaust after-treatment system comprises:

(a) directing an engine exhaust stream from an engine through the exhaust after-treatment device;

(b) introducing a combustible gas stream into the engine exhaust stream and combusting at least a portion of the combustible gas stream in the presence of a catalyst to heat the exhaust after-treatment device;

(c) introducing a supplemental liquid fuel stream into a hot gas stream to vaporize the supplemental liquid fuel stream, forming a combined fuel stream comprising the hot gas and vaporized supplemental liquid fuel;

(d) introducing the combined fuel stream into the engine exhaust stream; and (e) combusting at least a portion of the combined fuel stream in the presence of the catalyst to further heat the exhaust after-treatment device to at least a threshold temperature value suitable for regeneration.

The combustible gas stream and the hot gas stream can have substantially different compositions, for example, the combustible gas stream can be a syngas stream and the hot gas stream can be a flue gas stream.

In yet another aspect, a method of regenerating an exhaust after-treatment device in an exhaust after-treatment system comprises:

(a) directing an engine exhaust stream through the exhaust after-treatment device;

(b) operating a syngas generator to produce a product stream;

(c) introducing at least a portion of the product stream into the engine exhaust stream and combusting at least a portion of the product stream in the presence of a catalyst to heat the exhaust after-treatment device;

(d) introducing a supplemental liquid fuel stream into the product stream to vaporize the supplemental liquid fuel stream, forming a combined fuel stream comprising product stream, and vaporized supplemental liquid fuel; and (e) combusting at least a portion of the combined fuel stream in the presence of the catalyst to further heat the exhaust after-treatment device to at least a threshold temperature value suitable for regeneration.

The above-described method embodiments can further comprise monitoring a temperature in the exhaust after-treatment system and adjusting the mass flow rate of the supplemental liquid fuel introduced based on the temperature, for example, to assist with controlling the temperature in the after-treatment system.

In one aspect, an exhaust after-treatment system comprises:

(a) an exhaust conduit for conveying an engine exhaust stream from an engine to an exhaust after-treatment device;

(b) a combined fuel manifold for selectively introducing a supplemental fuel stream into the syngas stream upstream of the exhaust after-treatment device;

(c) at least one sensor for sensing an operating parameter of the exhaust after-treatment system; and (d) a controller configured to activate introduction of the syngas stream into the engine exhaust stream and then to activate introduction of the supplemental fuel stream into the syngas stream based on outputs from the at least one sensor.

Preferably the after-treatment system further comprises a catalyst located upstream of the exhaust after-treatment device and downstream of the combined fuel manifold, the catalyst capable of promoting combustion of a gas mixture comprising syngas and engine exhaust.

In another aspect an exhaust after-treatment system comprises:

(a) an exhaust after-treatment device;

(b) an exhaust conduit for conveying an engine exhaust stream from an engine to the exhaust after-treatment device;

(c) a syngas generator for producing a product gas stream;

(d) a combined fuel manifold for selectively introducing a supplemental liquid fuel stream into the product gas stream upstream of the after-treatment device;

(e) at least one sensor for sensing an operating parameter of the exhaust after-treatment system; and (f) a controller configured to activate introduction of the product gas stream into the engine exhaust stream and then to activate introduction of the supplemental liquid fuel stream into the product gas stream based on outputs from the at least one sensor.

In some embodiments of the after-treatment system, the liquid fuel supply port is connected to receive liquid diesel and the syngas supply port is connected to receive syngas generated by a syngas generator. Some embodiments of the method comprise generating the syngas stream using a syngas generator.

Some embodiments of the after-treatment system further comprise an engine exhaust by-pass conduit and an exhaust flow diverter for selectively diverting the engine exhaust stream to by-pass the after-treatment device.

In the above-described embodiments of a regeneration method and an exhaust after-treatment system, the liquid fuel is preferably diesel. A catalyst can be located within the after-treatment device and/or upstream of the after-treatment device. For example, a diesel oxidation catalyst (DOC) device comprising a catalyst that promotes the combustion of a syngas-engine exhaust mixture, can be located upstream of the after-treatment device.

DETAILED DESCRIPTION OF PREFERRED EMBODIMENTS

Figure 1:
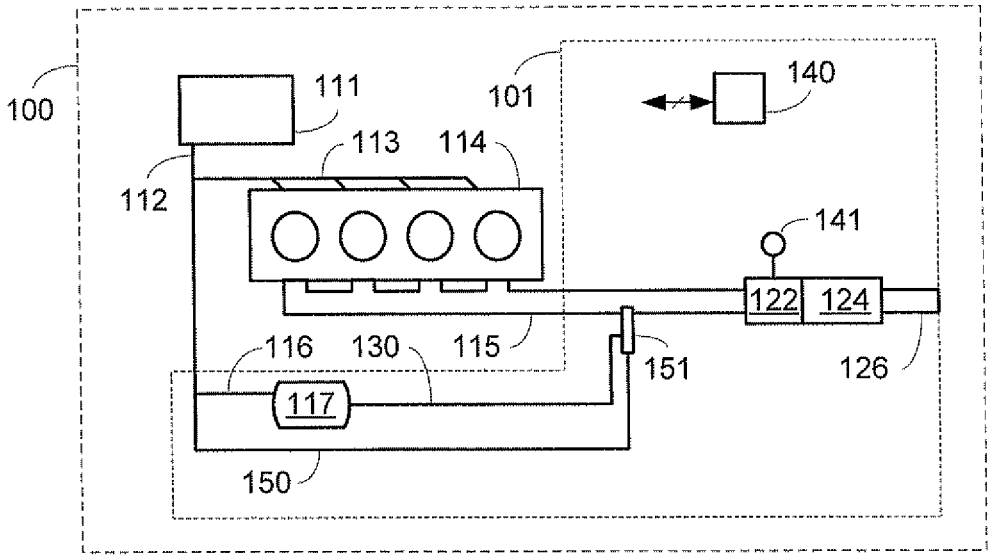
FIG. 1 is a simplified schematic representation of an embodiment of an engine system comprising an exhaust after-treatment system. The exhaust after-treatment system comprises apparatus for the selective introduction of a product stream from a syngas generator (SGG) and a supplemental fuel stream into an engine exhaust stream, upstream of an exhaust after-treatment device.

A fuel processor or a syngas generator (SGG) can convert a hydrocarbon reactant to a product stream containing hydrogen ($H_2$) and carbon monoxide (CO), also known as syngas. The equivalence ratio (ER) of the fuel and oxidant reactants introduced into the SGG can be adjusted to change the composition of the product stream produced, for example, so that the SGG produces a syngas stream or a flue gas stream. The term "equivalence ratio" herein refers to the ratio between the actual amount of oxygen supplied and the theoretical stoichiometric amount of oxygen that would be required for complete conversion of the fuel. An ER of greater than 1 represents a fuel lean mode (excess oxygen) that typically generates a flue gas stream, while an ER of less than 1 represents a fuel rich mode (excess fuel) that typically generates a syngas stream. The term "product stream" as used herein includes a flue gas stream or a syngas stream produced by a SGG.

As described above, a product stream of a SGG can be employed to actively regenerate an exhaust after-treatment device in an engine exhaust after-treatment system. During a regeneration process, a syngas stream can be employed to heat and/or create a reducing condition in the exhaust after-treatment device, while a flue gas stream can be employed for heating purposes.

In the present approach, during an initial portion of a regeneration process a syngas stream is directed to one or more exhaust after-treatment devices in an engine system and combusted to heat the exhaust after-treatment device and, during a subsequent portion of the regeneration process, a supplemental fuel stream is added to a product stream from a SGG to form a combined fuel stream, which is then directed to one or more after-treatment devices. Preferably the supplemental fuel is a liquid which is vaporized by the hot product stream from the SGG. Syngas is thereby employed to provide at least a portion of the heating duty, and the supplemental fuel is added to provide additional heating duty in the regeneration process. This can beneficially reduce the demand for syngas, which can, in turn, reduce the size and cost of the SGG used in the system. Furthermore, if the supplemental fuel has a higher energy value than syngas, this approach can increase the operational fuel efficiency of the exhaust after-treatment system.

The supplemental fuel can be conveniently be chosen to be the same fuel as the reactant fuel for the SGG and/or the fuel used for the engine in the system. For example, as described in the embodiments below, diesel can be used as a fuel in the engine, can be converted in the SGG to form a product stream, and can be used as the supplemental fuel. The liquid diesel is mixed with and vaporized by the hot temperatures of the SGG product stream, for example, typically ranging from about 500° C. to 1400° C.

FIGS. 1, 2, 4, 8 and 9 are simplified schematic representations of embodiments of engine systems that comprise a fuel tank 111, a fuel conduit 112, a fuel conduit 113, an engine 114, an exhaust conduit 115, a fuel conduit 116, and an SGG 117. Fuel tank 111 supplies diesel to engine 114 via fuel conduits 112 and 113, and to SGG 117 via fuel conduits 112 and 116. Control devices such as valves, sensors and communications lines (all not shown in FIGS. 1, 2, 4, 8 and 9) can be installed along fuel conduits 112 and/or 116 to control the diesel supply to engine 114 and SGG 117. Engine 111 is a lean burn engine (for example, a diesel engine), and is also supplied with an air stream supplied via an air supply system (not shown in FIGS. 1, 2, 4, 8 and 9). Engine 111 produces an engine exhaust stream containing various regulated emissions including, for example, NOx and/or particulate matter. The temperature of an engine exhaust stream from a diesel engine is typically in the range of about 170° C. to 450° C. The engine exhaust stream from engine 111 is directed and conveyed through exhaust conduit 115 into an exhaust after-treatment system.

SGG 117 is supplied with an oxidant, such as air and/or engine exhaust, via an oxidant supply sub-system (not shown in FIGS. 1, 2, 4, 8 and 9) and a fuel (in this example, diesel) supplied from fuel tank 111 via fuel conduits 112 and 116. SGG 117 thermochemically converts the fuel and oxidant into a product stream, for example, a syngas or flue gas stream. Typically the temperature of the product stream is in the range from about 500° C. to 1400° C.

The mass flow of oxidant and fuel introduced into SGG 117 can be varied to control the equivalence ratio (ER) of the reactants. The ER can be controlled by a controller that, along with control devices for example, valves, sensors and communications lines (all not shown in FIGS. 1, 2, 4, 8 and 9), also controls other elements of the exhaust after-treatment system. For example, the controller can also be employed to control regeneration processes for the exhaust after-treatment devices, and to control the introduction of supplemental fuel (for example, diesel) into the SGG product stream. The exhaust after-treatment system controller can optionally be integrated with one or more other controllers in the engine system, for example, it can be integrated with an engine control module.

Figure 2:
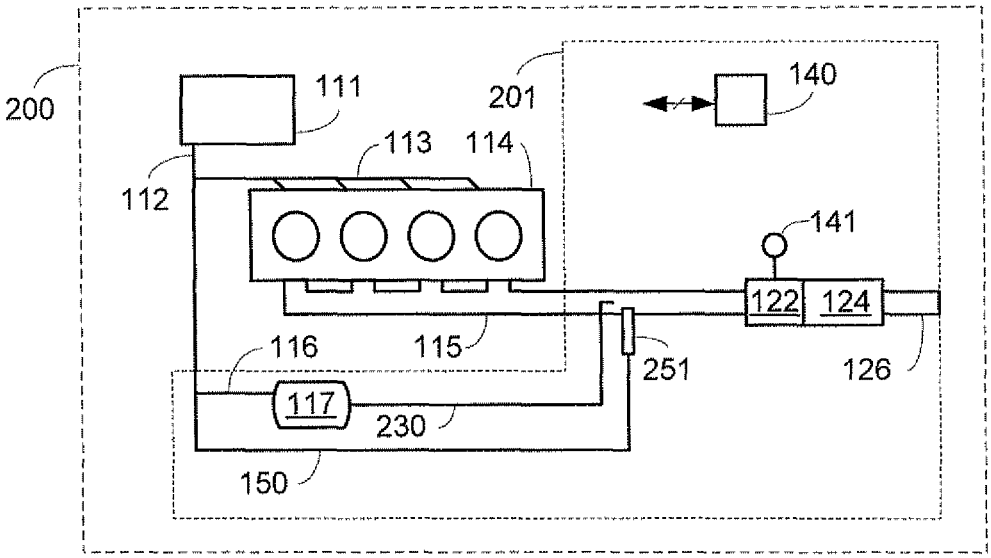
FIG. 2 is a simplified schematic representation of another embodiment of an engine system comprising an exhaust after-treatment system. The exhaust after-treatment system comprises apparatus for the selective introduction of a product stream from a syngas generator (SGG) and a supplemental fuel stream into an engine exhaust stream, upstream of an exhaust after-treatment device.

Turning to FIGS. 1 and 2, engine system 100 in FIG. 1 and engine system 200 in FIG. 2 each comprise an exhaust after-treatment system, 101 and 201 respectively. The after-treatment system further comprises diesel oxidation catalyst (DOC) 122, diesel particulate filter (DPF) 124, controller 140, sensor 141, outlet conduit 126 and fuel conduit 150. After-treatment system 101 in FIG. 1 also comprises a product conduit 130 and a combined fuel manifold 151, while after-treatment system 201 in FIG. 2 also comprises a product conduit 230 and a supplemental fuel nozzle 251. The engine exhaust stream from engine 111 is directed through exhaust conduit 115, DOC 122, and DPF 124 before exiting the engine system into the atmosphere via outlet conduit 126. Exhaust after-treatment system 101 in FIG. 1 and 201 in FIG. 2, can comprise additional or alternative exhaust after-treatment devices for reducing regulated emissions in the exhaust stream of the engine, for example, a lean NOx trap (LNT), or selective catalytic reduction (SCR) device.

DOC 122 contains a catalyst (wash-coated onto a substrate, for example, a cordierite monolith) which can promote oxidation of components of the engine exhaust stream, for example, to reduce the quantity of unburned hydrocarbons (HC) and carbon monoxide (CO) in the engine exhaust stream.

DPF 124 is a filter, for example a wall-flow monolith type of filter, which captures particulates in the engine exhaust stream. A catalyst can be incorporated within DPF 124 with or without a separate DOC device.

Controller 140, along with various associated sensors and control devices (not all shown in FIGS. 1 and 2), is employed to activate and control a multi-stage regeneration process of DPF 124, the production of a product stream by SGG 117 and the introduction of a supplemental fuel into the SGG product stream. For example, a sensor 141 can be located within DOC 122 or DPF 124, preferably near the vicinity of the catalyst, and configured to sense, for example, one or more of: gas pressure; pressure drop; temperature; mass flow rate; the quantity or concentration of nitrogen oxides, oxygen, or other gases in the engine exhaust stream; or other parameters. Sensor 141 can optionally comprise and employ additional sensors of the same or different types and can communicate various outputs to controller 140 via communication lines (not shown in FIGS. 1 and 2).

Fuel conduit 150 can employ control and sensing devices (not shown in FIGS. 1 and 2), controlled and activated by controller 140, to control the flow of diesel from fuel tank 111 and fuel conduit 112 into the product stream from SGG 117, for example, in an engine exhaust conduit or in a manifold upstream of the engine exhaust conduit. Optionally engine 114, SGG 117, and combined fuel manifold 151 (or in FIG. 2, supplemental fuel nozzle 251), are fluidly connected to receive a fuel stream from a common fuel source (fuel tank 111).

FIG. 1 illustrates an embodiment of an engine system 100 where a supplemental fuel stream is selectively introduced into a product stream from SGG 117 forming a combined fuel stream, prior to introduction into engine exhaust conduit 115. During operation of engine system 100, controller 140 and sensor 141 can monitor a pressure drop across DPF 124. When a first regeneration (pressure drop) threshold value has been achieved, controller 140 can initiate a first-stage of a heating/regeneration process. During the first-stage, controller 140 causes SGG 117 to produce a syngas stream which then flows via product conduit 130 and combined fuel manifold 151, into exhaust conduit 115 where it mixes and combines with engine exhaust from engine 111. Combined fuel manifold 151 can be located at a suitable location downstream of SGG 117 and upstream of DOC 122. The engine exhaust stream conveys the syngas into DOC 122 where it combusts, to produce heat which increases the temperature of DOC 122 and DPF 124 until it reaches a first temperature threshold value. This value can be, for example, a temperature that would be sufficient to initiate combustion of a mixed gas stream comprising syngas, diesel and engine exhaust. Once controller 140 determines, based on the output from sensor 141, that the first temperature threshold value has been reached, it can initiate a second-stage of the heating/regeneration process by activating the introduction of diesel into the syngas stream in combined fuel manifold 151 via fuel conduit 150. The liquid diesel stream is mixed with and vaporized by the syngas stream, forming a combined fuel stream. The combined fuel stream exits combined fuel manifold 151 and flows into exhaust conduit 115, where it mixes with the engine exhaust stream.

A similar two-stage heating/regeneration process can be used with the after-treatment system 201 shown in FIG. 2. However, in the embodiment shown in FIG. 2 in the second-stage the supplemental fuel stream is introduced into the SGG product stream within engine exhaust conduit 115. Diesel is introduced into conduit 115 via fuel nozzle 251, and is mixed with and vaporized by syngas from product conduit 130 also mixing with engine exhaust. Fuel nozzle 251 can be a device suitable for the introduction of a liquid fuel stream into a hot gas stream including, for example, a fuel injector, a spray nozzle, a tube, a valve, a fixed orifice device or an air-assist atomizing nozzle. Product conduit 230 can comprise a device (not shown in FIG. 2) to direct the flow of the SGG product stream in contact with the diesel as it exits nozzle 251.

Referring now to both FIGS. 1 and 2, in the second-stage of the heating/regeneration process the mixed gas stream comprising syngas, diesel and engine exhaust flows into DOC 122 where it combusts producing heat, further increasing the temperature of DOC 122 and DPF 124 to a second temperature threshold value. This value can be, for example, a temperature at which soot begins to oxidize at an appreciable rate. The oxidation of soot can be an exothermic and self-sustaining process. Controller 140 with input from sensor 141 can adjust the flow of syngas and/or supplemental fuel (diesel) based on a monitored parameter, for example, to adjust the temperature or rate of change to the temperature. When a second regeneration (pressure drop) threshold value has been achieved, controller 140 can terminate the heating/regeneration process. This typically includes stopping the flow of syngas and supplemental fuel into exhaust conduit 115. Optionally, after the flow of supplemental fuel has been terminated, a purge stream, for example, an air or nitrogen stream can be introduced into the supplemental fuel conduits (for example, in FIG. 1 fuel conduit 150 and/or combined fuel manifold 151, or in FIG. 2 fuel conduit 150 and/or fuel nozzle 251) to flush and remove residual fuel. This can reduce the amount of carbon or gum accumulating within the conduits. Controller 140 can determine when to repeat the regeneration process. In typical situations, the ignition temperature of the mixed gas stream (the mixture of the combined fuel stream with engine exhaust) within the DOC 122 is about 250° C.-400° C. The ignition temperature will be dependent on factors including, for example, the type and amount of catalyst present in the DOC 122, the oxygen content of the engine exhaust stream, and the composition of the mixed gas stream. Additional exhaust after-treatment devices can be employed in exhaust after-treatment system 101 in FIG. 1 and exhaust after-treatment system 201 in FIG. 2.

Figure 3:
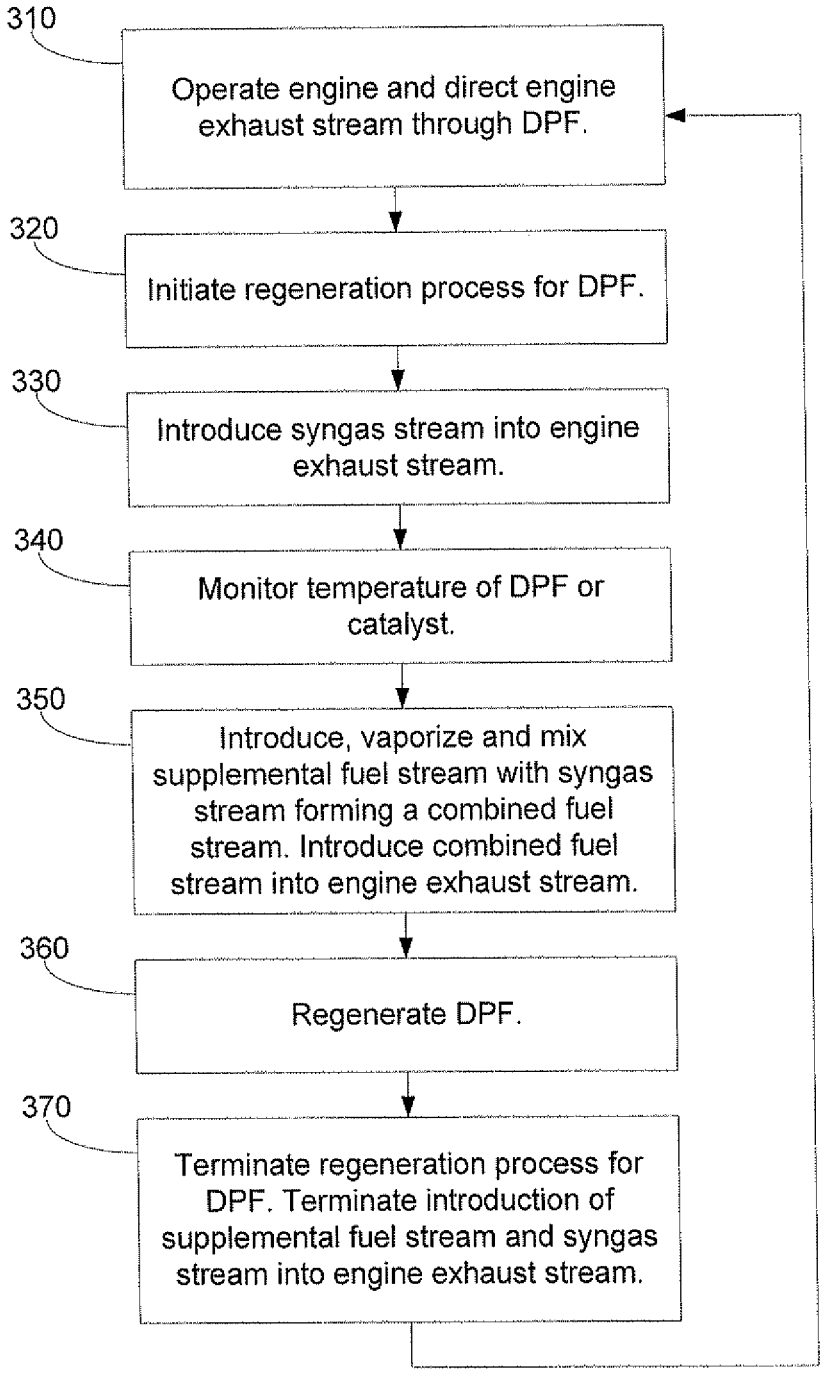
FIG. 3 is a flowchart illustrating an embodiment of a method for regenerating a diesel particulate filter (DPF) in an engine system.

FIG. 3 is a flowchart illustrating an embodiment of a method for regenerating a DPF in an engine system. In step 310 the engine is operating and producing an engine exhaust stream which is directed through an exhaust after-treatment system, comprising a DPF and an optional catalyst. The catalyst can be part of a DOC device located upstream of the DPF, and/or there can be a "pre-catalyst" located upstream of the DPF, and/or the DPF can comprise catalyst. The engine continues to operate and produce the engine exhaust stream during subsequent steps 320 through 370. In step 320 the regeneration process for the DPF is initiated as determined by a controller, for example, based on a predetermined schedule or in response to a sensed operating parameter indicating that regeneration of the DPF is necessary or desirable. In step 330 a syngas stream is introduced into the engine exhaust stream, and the mixed syngas and engine exhaust stream combusts exothermically in the presence of the catalyst in the exhaust after-treatment system. The resultant rise in temperature (for example, in the vicinity of the DPF or catalyst) is monitored in step 340, and once the temperature reaches a first temperature threshold value then in step 350 a supplemental fuel stream (for example, liquid diesel) is introduced into, vaporized and mixed with the syngas stream forming a combined fuel stream. The combined fuel stream is introduced, mixed with and conveyed by the engine exhaust stream, combusting in the presence of the catalyst in the exhaust after-treatment system. Optionally, the supplemental fuel is introduced into the syngas stream within the exhaust stream conduit and engine exhaust stream. This causes further heating, so that the DPF reaches a second temperature threshold value, for example, at which regeneration—comprising the oxidation and gasification of accumulated particulates—occurs in step 360. In step 370 the controller determines that the regeneration process for the DPF can be terminated (for example, the second temperature threshold value has been reached, or a certain time period has elapsed or a sensed operating parameter indicates that regeneration of the DPF is complete or should be terminated), and the introduction of diesel and syngas into the engine exhaust stream is terminated. Step 310 is repeated where the engine continues to operate, until the next DPF regeneration process is initiated in step 320.

Embodiments of the method for regenerating a DPF can comprise sensing the pressure drop between the inlet and outlet of the DPF and initiating the regeneration process (in step 320) and/or terminating the regeneration process (in step 370) based on, the sensed pressure drop, as pressure drop across a DPF is indicative of the degree of soot accumulation and therefore need for regeneration. Other parameters that can be employed, instead or as well, to trigger initiation and/or termination of the DPF regeneration process include the time duration of a preceding DPF operating state; the temperature in the vicinity of the catalyst, the temperature in the DPF or at some other location in the after-treatment system; and the oxygen content or mass flow rate of the engine exhaust stream.

Embodiments of the method for regenerating a DPF can further comprise sensing the temperature at one or more locations in the after-treatment system, and altering the mass flow rate of the supplemental fuel introduced into the engine exhaust stream based on the sensed temperature. Also, embodiments of the method for regenerating a DPF can further comprise sensing or calculating the mass flow rate of the engine exhaust stream and altering the mass flow rate of the supplemental fuel stream introduced into the engine exhaust stream based on the sensed or calculated mass flow rate of the engine exhaust stream. These approaches can be employed, for example, to prevent the temperature exceeding a value at which the DPF may be damaged, or to prevent the temperature of a DPF from falling below a temperature threshold value suitable for regeneration.

Figure 4:
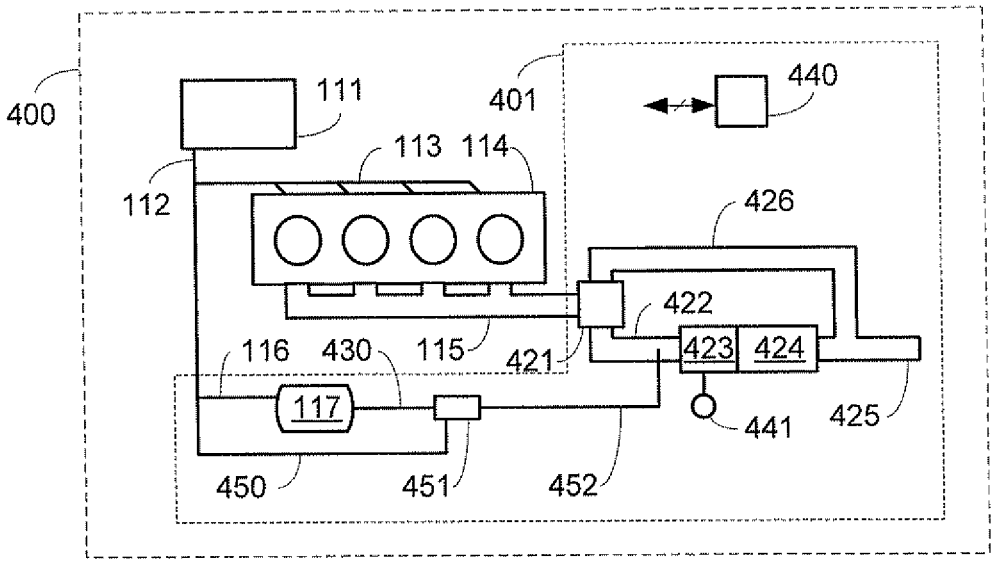
FIG. 4 is a simplified schematic representation of another embodiment of an engine system comprising an exhaust after-treatment system. The exhaust after-treatment system comprises apparatus for the selective introduction of a product stream from a syngas generator (SGG) and a supplemental fuel stream into an engine exhaust stream upstream of an exhaust after-treatment device.

FIG. 4 is a schematic representation of an embodiment of an engine system 400 where a supplemental fuel stream is introduced into a product stream from a SGG to regenerate and desulfate a LNT. Engine system 400 has components in common with the systems shown in FIGS. 1 and 2 as described above, and comprises after-treatment system 401. After-treatment system 401 comprises an exhaust diverter valve 421, an exhaust bypass conduit 426, a sensor 441, a controller 440, a diesel oxidation catalyst (DOC) 423, a lean NOx trap (LNT) 424, a fuel conduit 450, a combined fuel manifold 451 and a fuel conduit 452. LNT 424 is positioned within exhaust conduit 422 and traps NOx and SOx from the engine exhaust stream of engine 114. DOC 423 and LNT 424 contain a catalyst. Combined fuel manifold 451 is located at a suitable location downstream of SGG 117 and upstream of an exhaust after-treatment device, for example, DOC 423. Engine 114 produces an engine exhaust stream containing various regulated emissions including, for example, nitrogen oxides (NOx) and particulates. During an adsorption mode of LNT 424, the engine exhaust stream from engine 114 is directed and conveyed through exhaust conduit 115, exhaust diverter valve 421, exhaust conduit 422, diesel oxidation catalyst (DOC) 423, and LNT 424, before exiting engine system 400 into the atmosphere via outlet conduit 425. During a regeneration mode of LNT 424, at least periodically and/or at least a portion of the engine exhaust stream is directed by exhaust diverter valve 421 to flow through by-pass conduit 426, before exiting engine system 400 into the atmosphere via outlet conduit 425. Exhaust after-treatment system 401 can comprise additional exhaust after-treatment devices that can reduce the amount of regulated emissions in the engine exhaust stream.

DOC 423 contains a catalyst (wash-coated onto a substrate, for example, a cordierite monolith) which can promote oxidation of components of the engine exhaust stream, for example, to reduce the quantity of unburned hydrocarbons (HC) and carbon monoxide (CO), and convert nitric oxide (NO) to nitrogen dioxide ($NO_2$). LNT 424 comprises an adsorbent, for example, barium oxide incorporated into a catalyst washcoat.

Controller 440, along with various associated sensors and control devices (not all shown in FIG. 4), is employed to control a multi-stage regeneration process of LNT 424, the production of a product stream by SGG 117 and the introduction of a supplemental fuel into the SGG product stream. For example, a sensor 441 can be located in the vicinity of LNT 424 (preferably in the vicinity of a catalyst) and configured to sense, for example, one or more of: gas pressure; pressure drop; temperature; mass flow rate; the quantity or concentration of nitrogen oxides, oxygen, or other gases in the engine exhaust stream; or other parameters. Sensor 441 can comprise and employ additional sensors of the same or different types and can communicate one or more outputs to controller 440 via communication lines (not shown in FIG. 4).

Controller 440 can monitor an operating parameter, for example, a NOx level downstream of LNT 424 (NOx slip), to determine that regeneration of LNT 424 is desired. When a first regeneration threshold value has been achieved (for example, degree of NOx slip, composition of the engine exhaust stream downstream of LNT 424, or elapsed time), controller 440 can initiate a heating/regeneration process. During the first-stage of the heating/regeneration process, controller 440 causes SGG 117 to produce a syngas stream which flows into exhaust conduit 422 where it mixes with the engine exhaust stream produced by engine 114. The engine exhaust stream conveys the syngas into DOC 423 where it combusts to produce heat increasing the temperature of DOC 423 and LNT 424 to a first temperature threshold value. This value can be, for example, a temperature that would be sufficient to initiate combustion of a mixed gas stream comprising syngas, diesel and engine exhaust. Once controller 440 determines, (based on the output from sensor 441) that the first threshold temperature value has been reached, it can initiate a second-stage of a heating/regeneration process by activating introduction of diesel into the syngas stream in combined fuel manifold 451, via fuel conduit 450. The liquid diesel stream is mixed with and vaporized by the syngas stream, forming a combined fuel stream. The combined fuel stream exits combined fuel manifold 451 and flows into exhaust conduit 422 via fuel conduit 452, where it mixes with the engine exhaust stream.

The mixed gas stream comprising syngas, diesel and engine exhaust flows into DOC 423 where it catalytically combusts to produce heat, further increasing the temperature of DOC 423 and LNT 424 to a second temperature threshold value. This can be, for example, a temperature that would be suitable for regeneration (NOx desorption or desulfation) of LNT 424. At this point, the introduction of the supplemental fuel stream can be terminated and exhaust diverter valve 421 can be activated to direct some or substantially all of the engine exhaust stream through exhaust by-pass conduit 426. SGG 117 can continue to produce a syngas stream which flows into exhaust conduit 422, DOC 423 and LNT 424 creating a reducing environment for the regeneration process. When a second regeneration threshold value (for example, NOx slip, composition of exhaust stream downstream of LNT 424 or elapsed time) has been achieved, controller 440 can terminate the flow of syngas into exhaust conduit 422 and activate exhaust diverter valve 421 to allow the engine exhaust stream to flow through DOC 423 and LNT 424 via exhaust conduit 422, before exiting engine system 400 into the atmosphere via outlet conduit 425. Optionally, a fluid stream, for example, an air or nitrogen stream can be used to purge conduits 450, 452 and/or combined fuel manifold 451 as described above. Controller 440 can determine when it is necessary or desirable to repeat the regeneration process. The regeneration process can involve a desulfation process, for example, where the second temperature threshold value is higher than for NOx desorption, or where a third-stage heating process with a higher third temperature threshold value follows the first and second stages.

Figure 5:
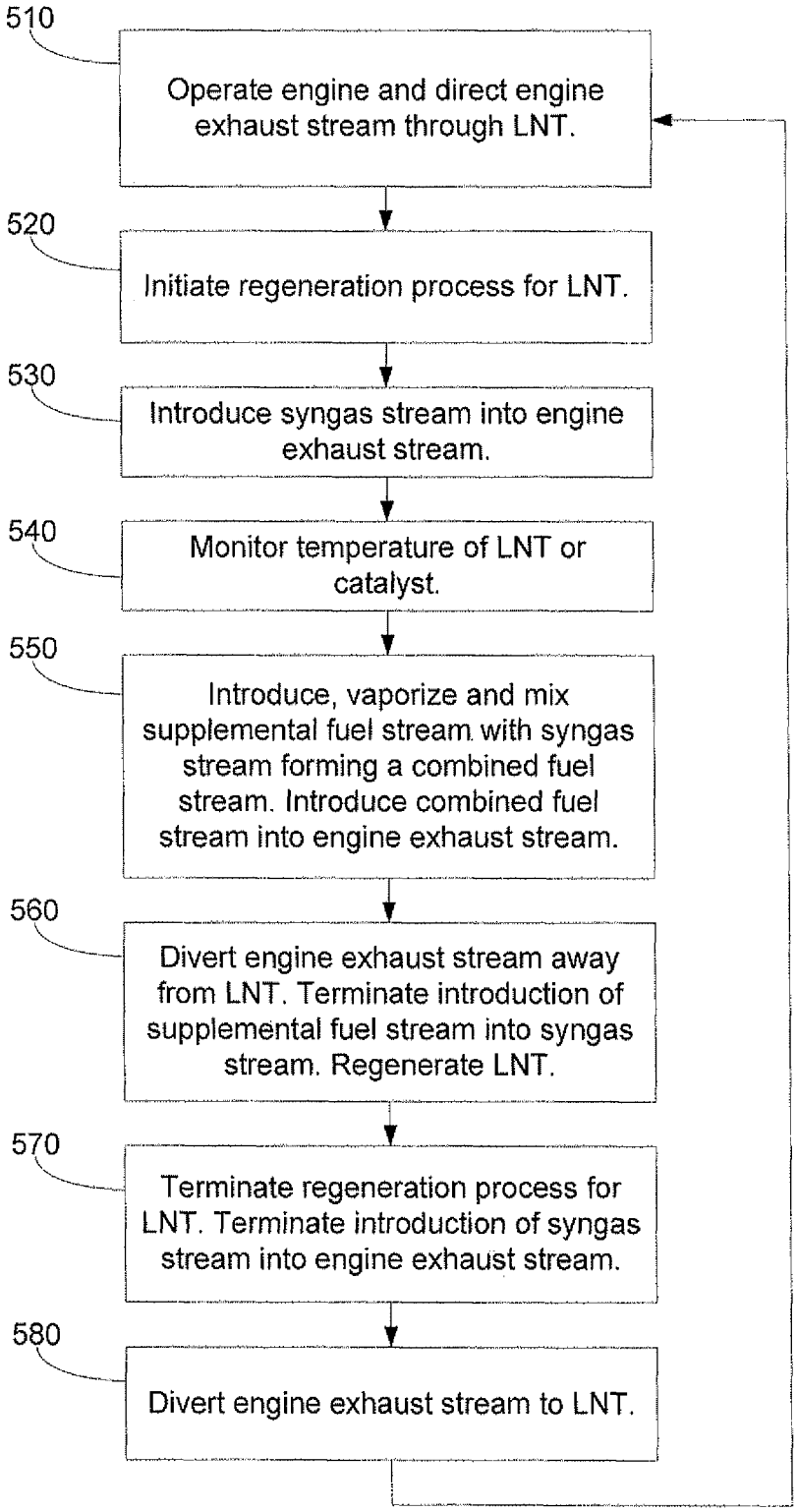
FIG. 5 is a flowchart illustrating an embodiment of a method for regenerating a lean NOx trap (LNT) in an engine system.

FIG. 5 is a flowchart illustrating an embodiment of a method of regenerating LNT in an engine system. In step 510 the engine is operating and producing an engine exhaust stream which is directed through an exhaust after-treatment system comprising a catalyst and a LNT. The catalyst can be part of the LNT, and/or or there can be a "pre-catalyst" located upstream of the LNT. The engine continues to operate and produce engine exhaust stream during subsequent steps 520 through 580. In step 520, a regeneration process for the LNT is initiated as determined by a controller, for example, based on a predetermined schedule or in response to a sensed operating parameter indicating that regeneration of the LNT is necessary or desirable. In step 530 a syngas stream is introduced into the engine exhaust stream, and the mixed syngas and engine exhaust stream combusts exothermically in the presence of the catalyst in the after-treatment system. The resultant rise in temperature is monitored in step 540, and once the temperature reaches a first temperature threshold value, then in step 550 a supplemental fuel stream (for example, liquid diesel) is introduced into, vaporized and mixed with the syngas stream forming a combined fuel stream. The combined fuel stream is introduced and mixed with the engine exhaust stream, forming a mixed gas stream which then combusts in the presence of the catalyst in the exhaust after-treatment system. Optionally, the supplemental fuel is instead introduced into the syngas stream within the exhaust stream conduit and engine exhaust stream. This causes further heating, so that the LNT reaches a second temperature value suitable for regeneration (NOx desorption and/or desulfation) of the LNT.

Upon reaching the regeneration temperature in step 560, the engine exhaust stream is preferably diverted away from the LNT in order to reduce the amount of oxygen present in the LNT. Also, the introduction of diesel into the syngas stream can be terminated in step 560, as diesel is not generally needed to sustain the LNT NOx desorption or desulfation processes (although diesel and engine exhaust stream can be re-introduced to raise the temperature if it drops below a desired temperature). The supply of syngas to the LNT continues during the regeneration process, and nitrogen and/or sulfur compounds are reduced, desorbed, and carried out of the LNT.

In step 570 the regeneration process for the LNT is terminated as determined by the controller (for example, after a certain time has elapsed or in response to a sensed operating parameter indicating that regeneration of the LNT is complete or should be terminated) and the introduction of syngas into the engine exhaust stream is terminated. In step 580 the exhaust gas diverter is activated to re-enable the flow of the engine exhaust stream through the LNT. Step 510 is repeated where the engine continues to operate until the next LNT regeneration process is initiated in step 520.

Embodiments of the method for regenerating a LNT can further comprise sensing or calculating the amount of NOx from the engine exhaust that slips past the LNT, and initiating the regeneration process (in step 520) and/or terminating the regeneration process (in step 570) based on the sensed NOx slip; NOx slip across an adsorbent bed can be indicative of degree of NOx and/or SOx adsorption capacity and therefore the desire for regeneration. Other parameters that can be employed to trigger initiation and termination of regeneration include the time duration of a preceding state; and oxygen slip past the LNT.

Embodiments of the method for regeneration of a LNT can further comprise sensing the temperature at one or more locations in the exhaust after-treatment system, and adjusting the mass flow rate of the liquid diesel stream introduced into the syngas stream based on the sensed temperature. This approach can be employed to assist in preventing the temperature of the LNT from falling below the temperature value suitable for LNT regeneration.

In embodiments of the present method, the supplemental fuel can be a liquid at ambient temperature when it is introduced into the vaporizer assembly where it is mixed with and vaporized by a product stream from a SGG. The interface between the supplemental fuel stream and SGG product stream is important in achieving complete or substantially complete fuel vaporization and thorough gas mixing.

Figure 6:
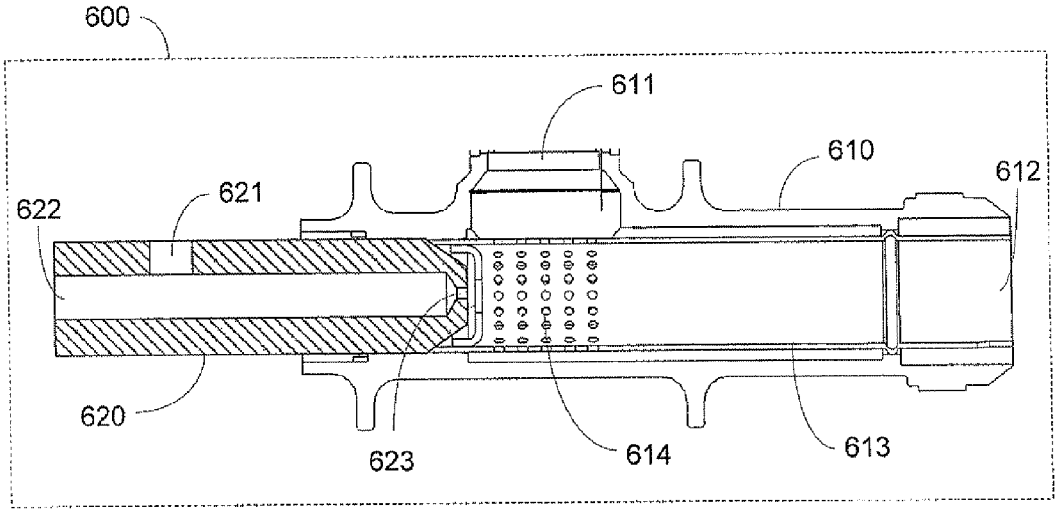
FIG. 6 is a cross-sectional view of an embodiment of a combined fuel manifold.

FIG. 6 illustrates an embodiment of a combined fuel manifold 600 which comprises a body 610, a supplemental fuel nozzle 620, product stream inlet port 611, inner tube 613 and combined fuel stream outlet port 612. Supplemental fuel nozzle 620 further comprises a supplemental fuel inlet port 621, an optional air inlet port 622 and a supplemental fuel outlet port 623. A product stream from a SGG can be introduced into the combined fuel manifold 600 through product stream inlet port 611, flowing though openings 614 in inner tube 613, before exiting through combined fuel stream outlet port 612. A supplemental fuel stream (for example, a liquid diesel stream) can be introduced, via supplemental fuel inlet port 621 and supplemental fuel outlet port 623, into the SGG product stream within inner tube 613. Here the liquid fuel stream mixes with and is vaporized by the SGG product stream, producing a combined fuel stream. When the addition of a supplemental fuel is no longer desired, a fluid stream, for example, an air or nitrogen stream can optionally be introduced into supplemental fuel inlet port 621 and/or air inlet port 622 to flush and remove fuel remaining within supplemental fuel nozzle 620 and supplemental fuel outlet port 623, reducing the tendency for carbon and/or gum to form. Supplemental fuel nozzle 620 can be a device suitable for the introduction of the liquid fuel stream into a hot gas stream including, for example, an air-assist atomizing nozzle, a fuel injector, a spray nozzle, or a tube.

Figure 7:
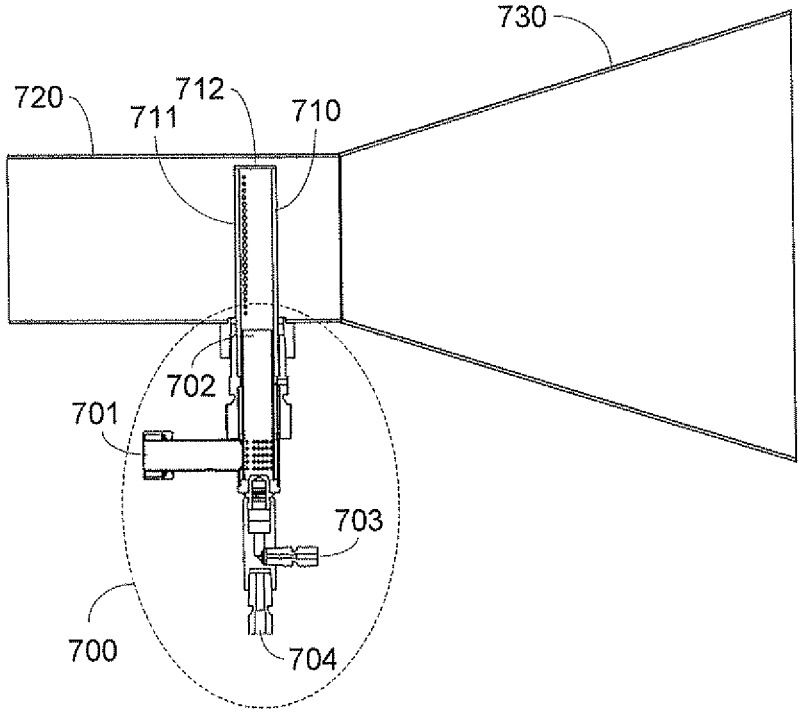
FIG. 7 is a cross-sectional view of another embodiment of a combined fuel manifold with an optional distribution manifold located within an engine exhaust conduit.

FIG. 7 illustrates another embodiment of a combined fuel manifold 700 with an optional distribution manifold 710 located within an exhaust conduit 720 of an engine system. Exhaust conduit 720 and diffuser 730 are fluidly connected to and located downstream of an engine and upstream of an exhaust after-treatment device (both not shown in FIG. 7). A product stream from a SGG (also not shown in FIG. 7) can be introduced into combined fuel manifold 700 via product stream inlet port 701 while a supplemental fuel stream can be introduced into combined fuel manifold 700 via supplemental fuel inlet port 703. Air can optionally be introduced via an optional air inlet port 704. The combined fuel stream exits combined fuel manifold 700 at combined fuel stream outlet port 702 and enters distribution manifold 710. Distribution manifold 710 comprises a multitude of longitudinal holes 711 and an optional end hole 712, each of which allow a product or combined fuel stream to pass into exhaust conduit 720 and diffuser 730. Holes 711 allow a SGG product stream or a combined fuel stream to mix efficiently with the passing engine exhaust stream from an engine, even when the mass flow rate of the engine exhaust stream is low. The holes can be provided in a single row along the longitudinal axis, in multiple rows along the longitudinal axis, around a portion of or the entire circumference of distribution manifold 710, and/or spaced randomly. The holes can be the same size as each other, or they can vary, for example, the holes can be larger toward the middle of distribution manifold 710 and smaller toward the ends of distribution manifold 710. The holes can be oriented to direct the fluid stream in a direction upstream in relation to the flow of the engine exhaust stream, or in another direction, or in more than one direction. When the addition of a supplemental fuel is no longer desired, a fluid stream, for example, an air or nitrogen stream can optionally be introduced into supplemental fuel inlet port 703 and/or air inlet port 704 to flush and remove fuel remaining within supplemental fuel nozzle 700 and supplemental fuel outlet port 702, reducing the tendency for carbon and/or gum to form.

The method described above can also be employed in engine systems comprising multi-leg exhaust after-treatment systems with one or more after-treatment devices in each leg. Such systems can comprise one or more SGGs; one or more flow diverters can be employed to distribute the SGG product stream and optionally the combined fuel stream to one or more exhaust after-treatment devices in one or more legs for regeneration. One or more supplemental fuel introduction assemblies can be located at suitable locations between the SGG(s) and flow diverter(s) or downstream of the flow diverter(s).

Figure 8:
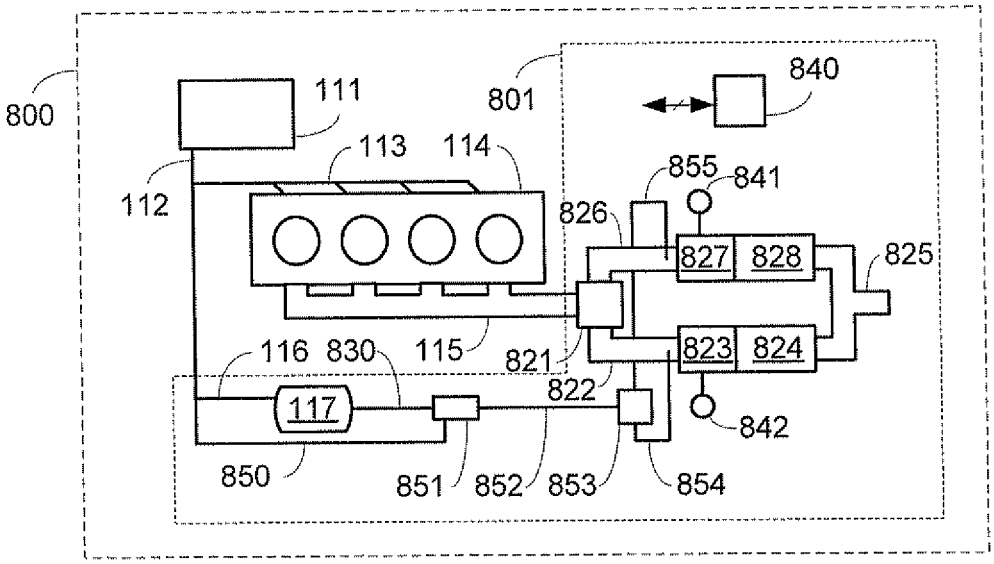
FIG. 8 is a simplified schematic representation of an embodiment of an engine system comprising a dual-leg exhaust conduit configuration and a combined fuel manifold for the selective introduction of a product stream from a syngas generator (SGG) and a supplemental fuel stream into an engine exhaust stream, upstream of a pair of exhaust after-treatment sub-systems.
Figure 9:
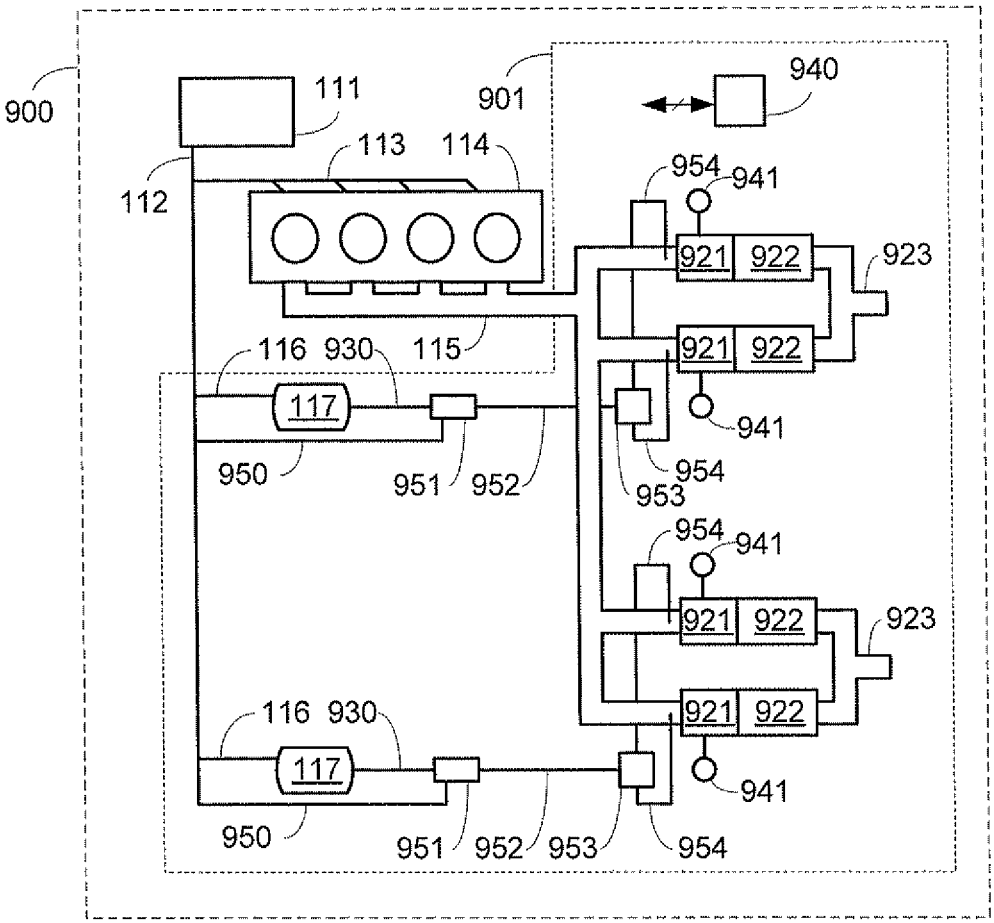
FIG. 9 is a simplified schematic representation of an embodiment of an engine system comprising a multi-leg exhaust conduit configuration, two syngas generators (SGGs) and combined fuel manifolds for the selective introduction of a product stream from a syngas generator and a supplemental fuel stream into an engine exhaust stream, upstream of two pairs of exhaust after-treatment sub-systems.

FIGS. 8 and 9 are simplified schematic representations of embodiments of engine systems comprising multi-leg exhaust after-treatment systems. FIG. 8 employs a single SGG, a combined fuel manifold, and a syngas diverter valve to supply and distribute a combined fuel stream and/or SGG product stream to a two-leg exhaust configuration. FIG. 9 employs two SGGs, two combined fuel manifolds and two syngas diverter valves to supply and distribute a combined fuel stream and/or SGG product stream to a four-leg exhaust configuration.

In FIG. 8, engine system 800 comprises an after-treatment system 801 comprising SGG 117, and further comprising an exhaust diverter valve 821, exhaust conduits 822, 826 and outlet conduit 825, DOCs 823 and 827, LNTs 824 and 828, a controller 840, sensors 841 and 842, fuel conduit 850, combined fuel manifold 851, conduit 852, syngas diverter valve 853 and syngas conduits 854 and 855. Combined fuel manifold 851 is located external to the housing of SGG 117 and external to exhaust conduits 115, 822 and 826, and can be located at a suitable location downstream of SGG 117 and upstream of DOCs 823 and 827. The product stream produced by SGG 117 and the supplemental fuel stream are introduced into combined fuel manifold 851. The resulting combined fuel stream flows into conduit 852, and is then directed by syngas diverter valve 853. If combined fuel manifold 851 is located upstream of syngas diverter valve 853 (as shown in FIG. 8) preferably it is positioned and operated in such a way as to reduce the likelihood of liquid fuel condensing within syngas diverter valve 853. A combined fuel manifold could instead be located downstream of each outlet of syngas diverter valve 853. Syngas diverter valve 853 can be controlled and actuated by controller 840 to selectively introduce a SGG product stream or combined fuel stream via conduit 854 into exhaust conduit 822, DOC 823 and LNT 824, or via conduit 855 into exhaust conduit 826, DOC 827 and LNT 828.

In FIG. 9, engine system 900 comprises an after-treatment system 901 comprising a pair of SGGs 117, and further comprising DOCs 921, DPFs 922, a controller 940, sensors 941, fuel conduits 950, conduits 930, combined fuel manifolds 951, conduits 952 and 954, syngas diverter valves 953, and outlet conduits 923. Combined fuel manifolds 951 are located external to the housing of SGGs 117 and external to engine exhaust conduits 115, and can be located at suitable locations downstream of SGGs 117 and upstream of DOCs 921. Combined fuel manifolds 951 could instead be located downstream of syngas diverter valves 953. The product stream produced by SGGs 117 and the supplemental fuel stream are introduced into combined fuel manifolds 951 via conduits 930 and 950 respectively. The resulting combined fuel stream flows into conduits 952, and is then directed by syngas diverter valves 953. Syngas diverter valves 953 can be controlled and actuated by controller 940 to selectively introduce a product stream or combined fuel stream into any of the four conduits 954, exhaust conduit legs 115, DOCs 921 and DPFs 922. Exhaust after-treatment system 901 can comprise additional or alternative devices, for example, engine exhaust diverter valves.

As described above, the present approach involves a multi-stage heating/regeneration process in which combustion of syngas is employed to increase the temperature of an after-treatment device during a first-stage, and during a subsequent stage a supplemental fuel is introduced into and is vaporized by the syngas (or another hot product stream from a SGG, such as flue gas) to form a combined fuel stream. The combined fuel stream is combusted to further increase the temperature of the after-treatment device in one or more subsequent stages. This approach can offer one or more of the following advantages:

(1) It can allow the use of a smaller SGG than if syngas was the only fuel supplied to the after-treatment device for heating/regeneration. For example, a relatively small SGG can be employed to provide syngas for an initial heating stage and then to provide syngas or flue gas for vaporization of the supplemental fuel. The supplemental fuel can be employed to provide the majority of the heating value during the subsequent heating stages.

(2) The fuel penalty is generally lower (that is, regeneration is more fuel efficient) compared to "syngas-only" regeneration systems; methods employing some of the supplemental fuel directly for heating the after-treatment device, rather than converting it to syngas, can result in a higher thermal efficiency.

(3) Relative to systems and methods that employ only diesel as a fuel for regeneration, using combustion of syngas during the first-stage to generate heat can allow lower catalyst loading of the DOC (or other catalyzed devices in the after-treatment system). This is because syngas ignites at a lower temperature than diesel. Because diesel is not introduced until the temperature in the after-treatment system is higher less catalyst may be needed for ignition.

(4) It reduces or eliminates the need to adjust engine operation for the purposes of regeneration, thereby de-coupling engine management from regeneration of devices in the exhaust after-treatment system. For example, the regeneration process can be decoupled from the outlet temperature of a turbocharger or turbocompressor of the engine.

(5) It can allow regeneration of the exhaust after-treatment system in engine system applications that operate at lower engine exhaust temperatures. The present system and method is less reliant on heat from the engine exhaust than prior approaches, since the heating duty to increase the temperature of the engine exhaust stream can be provided by the syngas and supplemental fuel streams.

(6) It can allow regeneration of the exhaust after-treatment system to be performed under engine idle conditions, or to continue even when engine operation drops to an idling condition during a regeneration cycle. With "syngas-only" regeneration systems and methods it can be challenging to reduce the syngas output sufficiently when the engine exhaust flow rate drops (for example, because of limits on the turndown ratio of the syngas generator). With the present approach, the quantity of supplemental fuel can be readily reduced to compensate for reduced engine exhaust flow, while still maintaining the fuel-to-exhaust ratio within a desired range.

(7) It can simplify syngas generator operation as the syngas stream can be supplied at a substantially constant mass flow rate during regeneration. The supply of the supplemental fuel can typically be varied more easily than the output of syngas generator can be adjusted. For example, the diesel mass flow rate can be readily adjusted in order to control or adjust the temperature of an after-treatment device during regeneration, and/or in response to variations in the engine exhaust flow rate.

In some embodiments of the present system and method, which involves a multi-stage heating/regeneration process, a syngas stream can be employed as a combustible fuel to generate heat in order to increase the temperature of an exhaust after-treatment device or system during an initial heating stage, and then switch to using a hot gas (not necessarily combustible) of a different composition to vaporize a supplemental fuel that is introduced and then combusted to further increase the temperature of the exhaust after-treatment device or system in a subsequent stage of heating. For example, during an initial heating stage, a syngas generator could be operated to produce syngas as a combustible fuel to generate heat, while during a subsequent heating stage the syngas generator could be operated to produce a flue gas stream that is employed to vaporize a supplemental fuel, which is then employed as a combustible fuel to generate further heat. For regeneration of some exhaust after-treatment devices, the carbon monoxide and/or hydrogen in the syngas are beneficial in the regeneration process, in which case it can be preferable to produce and employ syngas during subsequent heating stage(s) as well as during the initial stage.

Although the supplemental fuel can be gaseous, the present system and method are particularly suitable if the supplemental fuel is a liquid. In preferred embodiments of the present system and method, the supplemental fuel is liquid diesel. Other suitable liquid fuels can be employed, for example, liquid gasoline or other liquid hydrocarbon fuels. The present system and method are also particularly suitable if the supplemental fuel has a higher energy value and a higher ignition temperature than syngas. The supplemental fuel does not have to be the same fuel as the reactant fuel for the SGG and/or the fuel used for the engine in the system, but it is generally more convenient if this is the case.

The present systems and methods can be applied to the heating and regeneration of other engine exhaust after-treatment devices, such as a selective catalytic reduction (SCR) device, or a methane oxidation catalyst bed.

The present systems and methods can be employed to heat and regenerate more than one exhaust after-treatment device in an exhaust after-treatment system at the same time or at different times. As used herein the term "device" can refer to an entire device, or a portion or a segment of an exhaust after-treatment device.

In embodiments of the above-described systems and methods, instead of providing a catalyst that promotes ignition and combustion of the fuel and/or supplemental fuel stream introduced into the engine exhaust stream upstream of or within an exhaust after-treatment device, another mechanism or device can be provided for this purpose, for example, an igniter, spark plug, glow plug or hot element.

The exhaust conduit can include additional structures such as mixing vanes (not shown), or rotating elements (not shown) to promote mixing of the SGG product stream and combined fuel stream with the engine exhaust stream. In practice, it is desirable to introduce the syngas stream and/or combined fuel stream into the engine exhaust stream at a sufficient distance upstream of the after-treatment device(s) to allow thorough mixing of the various streams prior to introduction into the after-treatment device(s), yet short enough (and/or well insulated or heated) in order to reduce heat loss that could cause vaporized liquid fuel to condense.

The present systems and methods are particularly suited for regeneration of after-treatment devices in mobile or stationary engine applications; however they can also be applied for regeneration of after-treatment devices used to reduce regulated emissions in other types of systems and applications.

Furthermore, a fuel processor and supplemental fuel introduction assembly, and associated methods wherein a supplemental fuel is introduced into the SGG product stream forming a combined fuel stream, can be deployed for increasing the energy of a product stream from a SGG for other applications where supplemental fuel could provide at least a portion of the heating duty of the combined product stream. The product syngas stream and/or combined fuel stream can be directed to one or more hydrogen-consuming devices, for example, an exhaust after-treatment device, a fuel cell, or a combustion engine.

The fuel processor or SGG can be catalytic or non-catalytic reactors or reformers of any suitable type including, steam reformers (SR), partial oxidation (POX) reactors or autothermal reformers (ATR).

The fuel supplied to the fuel processor can be a liquid fuel (herein meaning a fuel that is a liquid when under IUPAC defined conditions of standard temperature and pressure) or a gaseous fuel. Suitable liquid fuels include, for example, diesel, gasoline, kerosene, liquefied natural gas (LNG), fuel oil, methanol, ethanol or other alcohol fuels, liquefied petroleum gas (LPG), or other liquid fuels from which hydrogen can be derived. Alternative gaseous fuels include natural gas and propane. Fuels can include oxygenated fuels.

In preferred embodiments of the systems and methods described above, the engine is a lean burn combustion engine. However, the engine can be a near stoichiometric air-to-fuel ratio type engine. The engine can be of various designs including reciprocating piston, Wankel, and gas turbine, can be naturally aspirated or forced induction, and can be part of a vehicular or non-vehicular system. Suitable fuels supplied to the engine include, for example, diesel, gasoline, kerosene, liquefied natural gas (LNG), fuel oil, methanol, ethanol or other alcohol fuels, liquefied petroleum gas (LPG), jet, biofuel, natural gas or propane.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A method of regenerating an exhaust after-treatment device in an exhaust after-treatment system, said method comprising:

(a) directing an engine exhaust stream from an engine through said exhaust after-treatment device;

(b) introducing a syngas stream into said engine exhaust stream and combusting at least a portion of said syngas in the presence of a catalyst to heat said exhaust after-treatment device;

(c) subsequently introducing a supplemental liquid fuel stream into said syngas stream to vaporize said supplemental liquid fuel stream, forming a mixed gas stream comprising syngas, vaporized liquid fuel and engine exhaust; and (d) combusting at least a portion of said mixed gas stream in the presence of said catalyst to further heat said exhaust after-treatment device.

2. The method of claim 1 further comprising monitoring a temperature in said exhaust after-treatment system, and initiating step (c) when said temperature reaches a first threshold value.

3. The method of claim 2 wherein said temperature is monitored in the vicinity of said catalyst, and said first temperature threshold value is at least the ignition temperature of said mixed gas stream.

4. The method of claim 2 wherein in step (d) said combusting heats said exhaust after-treatment device so that it reaches at least a second temperature threshold value that is suitable for regeneration of said exhaust after-treatment device.

5. The method of claim 2 wherein said after-treatment device is a particulate filter.

6. The method of claim 5 further comprising monitoring a pressure drop in said exhaust after-treatment system, and initiating step (b) when said pressure drop increases above a first pressure drop threshold value, and terminating said introduction of said syngas stream and said supplemental fuel stream when said pressure drop drops below a second pressure drop threshold value, whereby regeneration of said after-treatment device is terminated.

7. The method of claim 2 wherein said after-treatment device is a lean NOx trap.

8. The method of claim 7 further comprising monitoring for NOx slip past said lean NOx trap, and initiating step (b) when said NOx slip increases above a first NOx slip threshold value.

9. The method of claim 7 wherein in step (d) said combusting heats said lean NOx trap so that it reaches at least a second temperature threshold value that is suitable for regeneration of said lean NOx trap, and wherein said method further comprises:

(e) monitoring a temperature in said exhaust after-treatment system; and (f) once said second temperature threshold value is reached, diverting said engine exhaust stream so that it bypasses said lean NOx trap and stopping said introduction of said supplemental liquid fuel stream into said syngas stream.

10. The method of claim 7 wherein said regeneration method removes trapped sulfur compounds from said lean NOx trap.

11. The method of claim 1 wherein said liquid fuel comprises diesel.

12. The method of claim 1 further comprising monitoring a temperature in said exhaust after-treatment system and adjusting the mass flow rate of said supplemental fuel stream introduced in step (c) based on said temperature.

13. The method of claim 1 further comprising monitoring at least one operating parameter of said exhaust after-treatment system, and selectively introducing said syngas stream into said engine exhaust stream in step (b) based on the value of at least a first one of said monitored parameters, and selectively introducing said supplemental liquid fuel stream into said syngas stream in step (c) based on the value of at least a second one of said monitored parameters.

14. The method of claim 13 wherein said first parameter and said second parameter are each selected from the group consisting of elapsed time, temperature at a location in said exhaust after-treatment system, pressure at a location in said exhaust after-treatment system, pressure drop across at least a portion of said exhaust after-treatment system, and engine exhaust stream mass flow rate.

15. An exhaust after-treatment system comprising:

(a) an engine, an after-treatment device, and an exhaust conduit for conveying an engine exhaust stream from said engine to said exhaust after-treatment device;

(b) a combined fuel manifold for selectively introducing a supplemental fuel stream into a syngas stream upstream of said exhaust after-treatment device;

(c) at least one sensor for sensing an operating parameter of said exhaust after-treatment system; and (d) a controller configured to activate introduction of said syngas stream into said engine exhaust stream and then to activate introduction of said supplemental fuel stream into said syngas stream based on outputs from said at least one sensor.

16. The after-treatment system of claim 15 wherein said controller is configured to activate introduction of said syngas stream into said engine exhaust stream when an output from said at least one sensor indicates that it is desirable to regenerate said device.

17. The after-treatment system of claim 15 further comprising a catalyst located upstream of said exhaust after-treatment device and downstream of said combined fuel manifold, said catalyst capable of promoting combustion of a gas mixture comprising syngas and engine exhaust.

18. The after-treatment system of claim 15 wherein said controller is configured to activate introduction of said syngas stream into said engine exhaust stream based on an output of a temperature sensor located in said after-treatment system.

19. The after-treatment system of claim 18 wherein said controller is configured to activate introduction of said supplemental fuel stream into said syngas stream based on an output of said temperature sensor.

20. The after-treatment system of claim 19 wherein said controller is configured to activate introduction of said supplemental fuel stream into said syngas stream when said output of said temperature sensor indicates that the temperature in the vicinity of said catalyst has reached a first temperature threshold value.

21. The after-treatment system of claim 15 wherein said combined fuel manifold is connected to receive liquid diesel.

22. The after-treatment system of claim 15 wherein said combined fuel manifold and said engine are fluidly connected to a common fuel source.

23. The after-treatment system of claim 15 further comprising a syngas generator connected to selectively supply said syngas stream that is introduced into said engine exhaust stream.

24. The after-treatment system of claim 15 further comprising an engine exhaust by-pass conduit and an exhaust flow diverter for selectively diverting said engine exhaust stream to by-pass said after-treatment device.

25. The system of claim 15 wherein said after-treatment device is a lean NOx trap.

26. A method of regenerating an exhaust after-treatment device in an exhaust after-treatment system, said method comprising:

(a) directing an engine exhaust stream from an engine through said exhaust after-treatment device;

(b) introducing a syngas stream into said engine exhaust stream and combusting at least a portion of said syngas stream in the presence of a catalyst to heat said exhaust after-treatment device;

(c) introducing a supplemental liquid fuel stream into a hot gas stream to vaporize said supplemental liquid fuel stream, forming a combined fuel stream comprising said hot gas and vaporized supplemental liquid fuel;

(d) introducing said combined fuel stream into said engine exhaust stream; and (e) combusting at least a portion of said combined fuel stream in the presence of said catalyst to further heat said exhaust after-treatment device to at least a threshold temperature value suitable for regeneration.

27. The method of claim 26 wherein said syngas stream and said hot gas stream have substantially different compositions.

28. The method of claim 27 wherein said hot gas stream is a flue gas stream

29. A method of regenerating an exhaust after-treatment device in an exhaust after-treatment system, said method comprising:

(a) directing an engine exhaust stream through said exhaust after-treatment device;

(b) operating a syngas generator to produce a product stream;

(c) introducing at least a portion of said product stream into said engine exhaust stream and combusting at least a portion of said product stream in the presence of a catalyst to heat said exhaust after-treatment device;

(d) introducing a supplemental liquid fuel stream into said product stream to vaporize said supplemental liquid fuel stream, forming a combined fuel stream comprising product stream, and vaporized supplemental liquid fuel; and (e) combusting at least a portion of said combined fuel stream in the presence of said catalyst to further heat said exhaust after-treatment device to at least a threshold temperature value suitable for regeneration.

* * * * *